United States Patent [19]

Feuerstacke

[11] Patent Number: 5,000,250

[45] Date of Patent: Mar. 19, 1991

[54] STRIP CASTING WITH AN ENDLESS BELT

[75] Inventor: Ewald Feuerstacke, Dorsten, Fed. Rep. of Germany

[73] Assignee: Mannesmann AG, Duesseldorf, Fed. Rep. of Germany

[21] Appl. No.: 328,161

[22] Filed: Mar. 24, 1989

[30] Foreign Application Priority Data

Mar. 24, 1988 [DE] Fed. Rep. of Germany ..... 3810302

[51] Int. Cl.[5] ..... B22D 11/16

[52] U.S. Cl. ..... 164/155; 164/437

[58] Field of Search ..... 164/155, 427, 429, 431, 164/434, 437, 451–453, 488

[56] References Cited

U.S. PATENT DOCUMENTS

| | | | |
|---|---|---|---|
| 4,449,568 | 5/1984 | Narisimham | 164/453 |
| 4,602,668 | 7/1986 | Bolliger | 164/452 |

FOREIGN PATENT DOCUMENTS

| | | | |
|---|---|---|---|
| 3403152 | 4/1985 | Fed. Rep. of Germany | 164/453 |
| 150646 | 8/1984 | Japan | 164/429 |
| 144251 | 7/1986 | Japan | 164/452 |

*Primary Examiner*—Richard K. Seidel
*Assistant Examiner*—Edward A. Brown
*Attorney, Agent, or Firm*—Ralf H. Siegemund

[57] ABSTRACT

In a casting device for the continuous production of metal strip using an endless cooling and transport belt; a distributor is constructed as twin chamber with an entrance and charge chamber, and an exit and discharge chamber communicating with the entrance chamber, a nozzle is provided at the exit and discharge chamber, the distributor, at least in the range of the discharge chamber, is gas tightly closed and is mounted in an inclination-adjustable frame; a gas pressure controllable source is connected to the discharge chamber and controlled in response to thickness variations of the strip; a distance measuring device (ram pressure) is arranged at the casting nozzle for measuring the distance of the casting nozzle from the casting belt; a controller responds to the measuring output of the distance measuring device and provides for controlling the elevational and vertical disposition of the distributor within said frame; another controller varies elevation of the upper belt stringer, also in response to thickness variations of the strip being made.

8 Claims, 4 Drawing Sheets

STRIP CASTING WITH AN ENDLESS BELT

BACKGROUND OF THE INVENTION

The present invention relates to continuous casting of metal strip, particularly steel strip wherein the molten metal is discharged from a nozzle having preferably a width that corresponds to the width of the strip to be made and the metal is being deposited onto a continuously moved cooled transport belt, strip or the like and wherein the nozzle extends in a plane oriented with respect to the thickness of the metal strip to be made; it is arranged at an acute angle thereto.

Devices of the kind to which the invention pertain are shown e.g. in German patent application No. 37 07 897 corresponding to U.S. Pat. No. 4,836,271.

DESCRIPTION OF THE INVENTION

It is an object of the present invention to provide a new and improved equipment of the kind referred to above as prior art so as to improve the quality of thin steel strip made in that manner and to improve managibility and operational safety of the equipment.

With regard to the direction of casting during the continuous manufacture of the metal strip under utilization of a circulating, endless transport and casting belt and under further utilization of a distributor with nozzle, the cooling and transport belt is mounted on and is supported by a frame which has an inclination to the horizontal. The distributor and casting vessel is adjustably mounted in the frame, adjustability referring to elevation within that frame. In order to improve such an arrangement it is suggested to provide the distributor as a twin chamber vessel wherein one of the chambers has the casting nozzle and is gas tightly sealed above the melted material and is connected to a pressure controlled source of gas while downstream from the casting nozzle a position adjustable smoothing roller is provided; at least one distance measuring device is connected to the casting nozzle for ascertaining and measuring the relative disposition of the casting nozzle vis-a-vis the transport and cooling belt and the distributor nozzle spacing for the belt can be changed on the basis of the measurement by means of an appropriate controller towards maintaining constant the product thickness.

In furtherance of the invention it is suggested to provide a ram pressure or pressure head type measuring instrument for determining the distance between the nozzle and the casting belt. The opening of that measuring device is arranged in the plane of the exit nozzle and on the particular wall of the casting nozzle which faces the oncoming belt and the exit opening of the casting nozzle is inclined in relation to the surface nozzle of the cooling belt such that the angle of inclination opens in the direction of belt movement. Still in furtherance of the invention it is suggested that, as seen in the direction of belt movement, a certain structure is provided downstream from the casting nozzle by means of which the thickness of the strip as cast can be measured; the measured value is compared with a desired value in a control circuit or the like and the controller controls the gas source connected to the vessel with the nozzles towards changing pressure so as to control the strip thickness by controlling the outflow of the molten material from the discharge chamber of the vessel.

The product thickness is preferably measured through an instrument working on the basis of radiometry. In deviating from the inventive method above the radiometrically operating instrument may be connected with another controller which in turn is connected to a support element and adjusting structure arranged below the upper stringer of the transport and cooling belt providing elevational adjustment. This support element specifically is situated directly underneath the casting nozzle and is used in that fashion for controlling the strip thickness. Plural measuring instruments may be provided in furtherance of the invention wherein each instrument is separately connected to another support element through an appropriate controller.

In accordance with another feature of the invention it is suggested that in the case the nozzle does in fact have a width that corresponds to the width of the strip to be cast, the measuring device for measuring the distance from the belt is arranged in the outer zones or areas of the casting nozzle in order to avoid tilting of the strip in relation to the casting nozzle. This way one avoids formation of a nonuniform thickness in the product being cast.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Proceeding now to the detailed description of the drawings, FIG. 1 illustrates an endless cooling and transport belt 9 running through transport rollers 20 and 21 and being driven for endless circulation. This belt 9 is provided for the purpose of supporting the continuous casting of metal strip 19 extracted by means of rolls 29. A cooling and smoothing roller 1 is disposed above the belt 9 which roller can be adjustable as far as its position and relation to the belt 9 is concerned under utilization of an adjustment and hydraulic drive 22. The belt 9 including particularly its transport rollers 20 and 21 which are supported by and mounted in relation to and on a frame 2 which has a variable and adjustable inclination to the horizontal. For this purpose frame 2 is hingedly mounted on one side under utilization of a hinge or pivot axis 4 which of course extends transversely to the direction of belt movement which is transverse to the plane of the drawing of FIG. 1. On the opposite side, the frame rests on a vertically arranged hydraulically operated adjustment drive 16.

Figure 1:
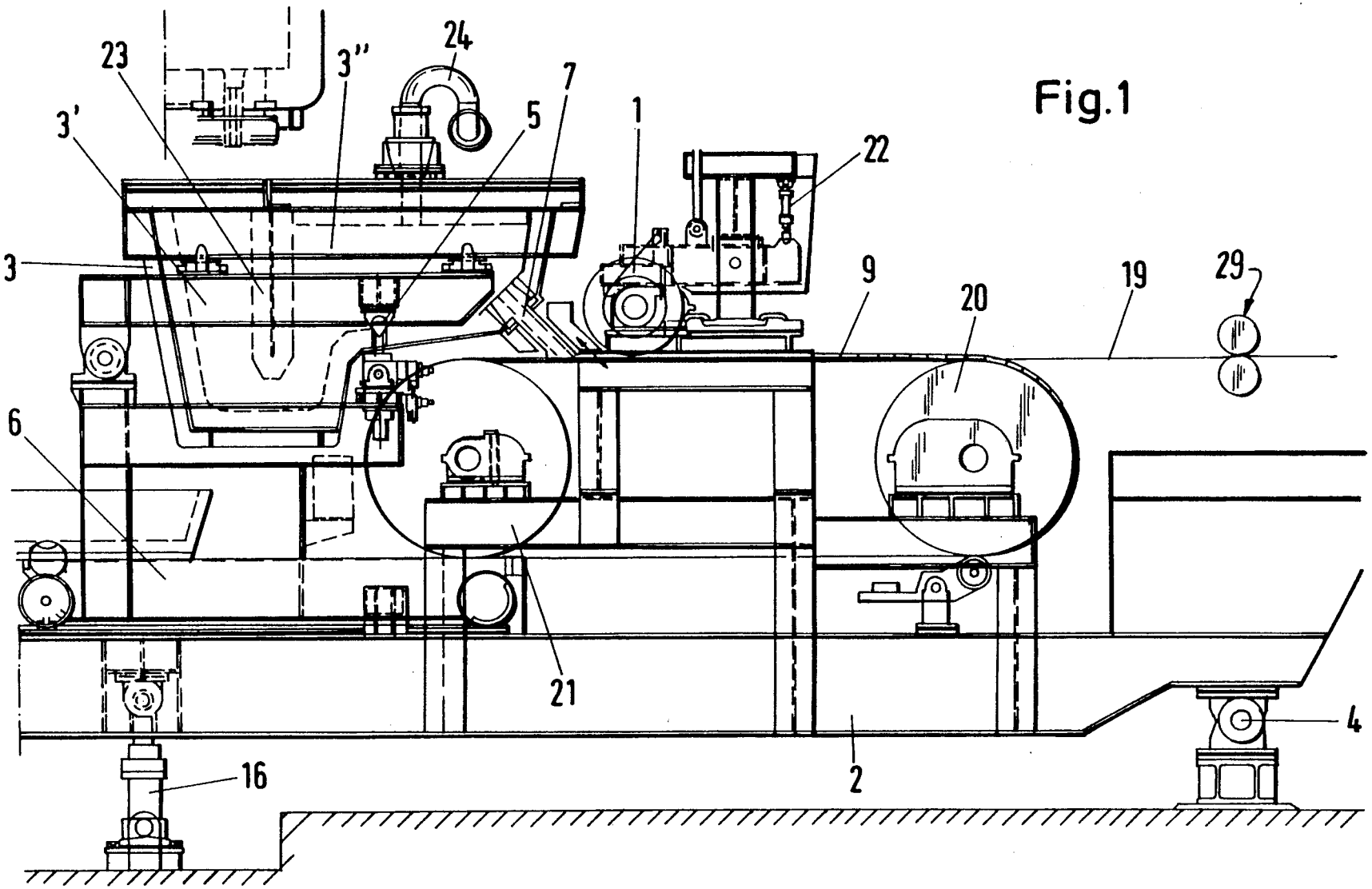
FIG. 1 is a side view of casting equipment in accordance with the preferred embodiment of the present invention for practicing the best mode thereof.

Reference numeral 24 refers to a source of gas connected to a discharge chamber 3'' of a distributor and casting vessel 3. That vessel is provided within the frame 2 in that particular vessel 3 is adjustably mounted within the frame 2. The vessel 3 is further comprised of an inlet or charge chamber 3' in addition to the exit and discharge chamber 3''. A casting nozzle 7 in turn is connected to the discharge chamber 3'. Nozzle 7 is inclined towards the horizontal as illustrated. The casting chamber 3 is gas tightly sealed in a level above the molten material therein. The twin chamber vessel 3 (3', 3'') serves as distributor and dispensing unit for the molten metal and for this purpose a partition 23 is provided which separates chamber 3' from chamber 3''. This partition or central partition 23 extends from above into the distributor and particularly the molten material therein.

Figure 2:
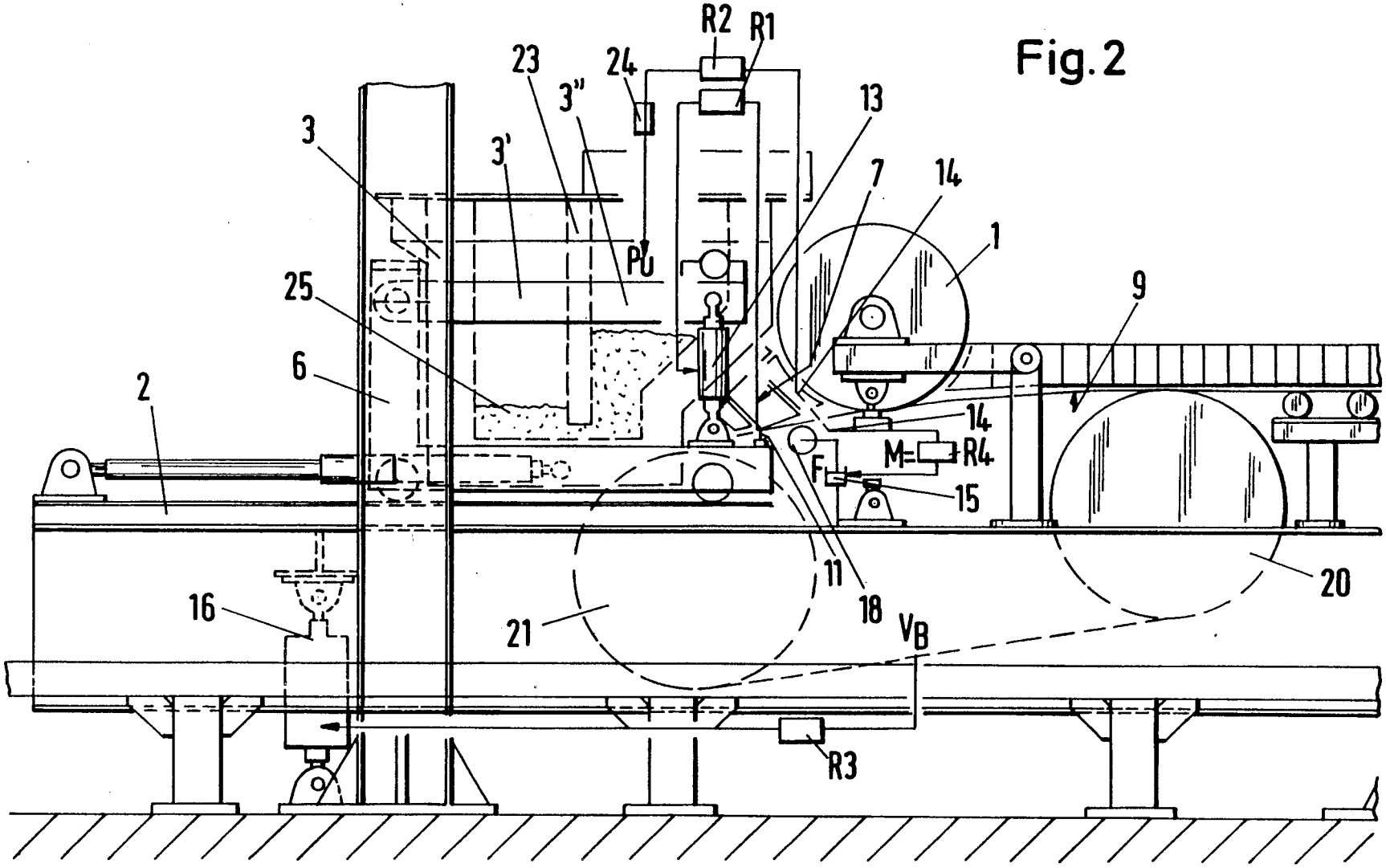
FIG. 2 is a similar view but showing in addition control features and circuits.
Figure 3:
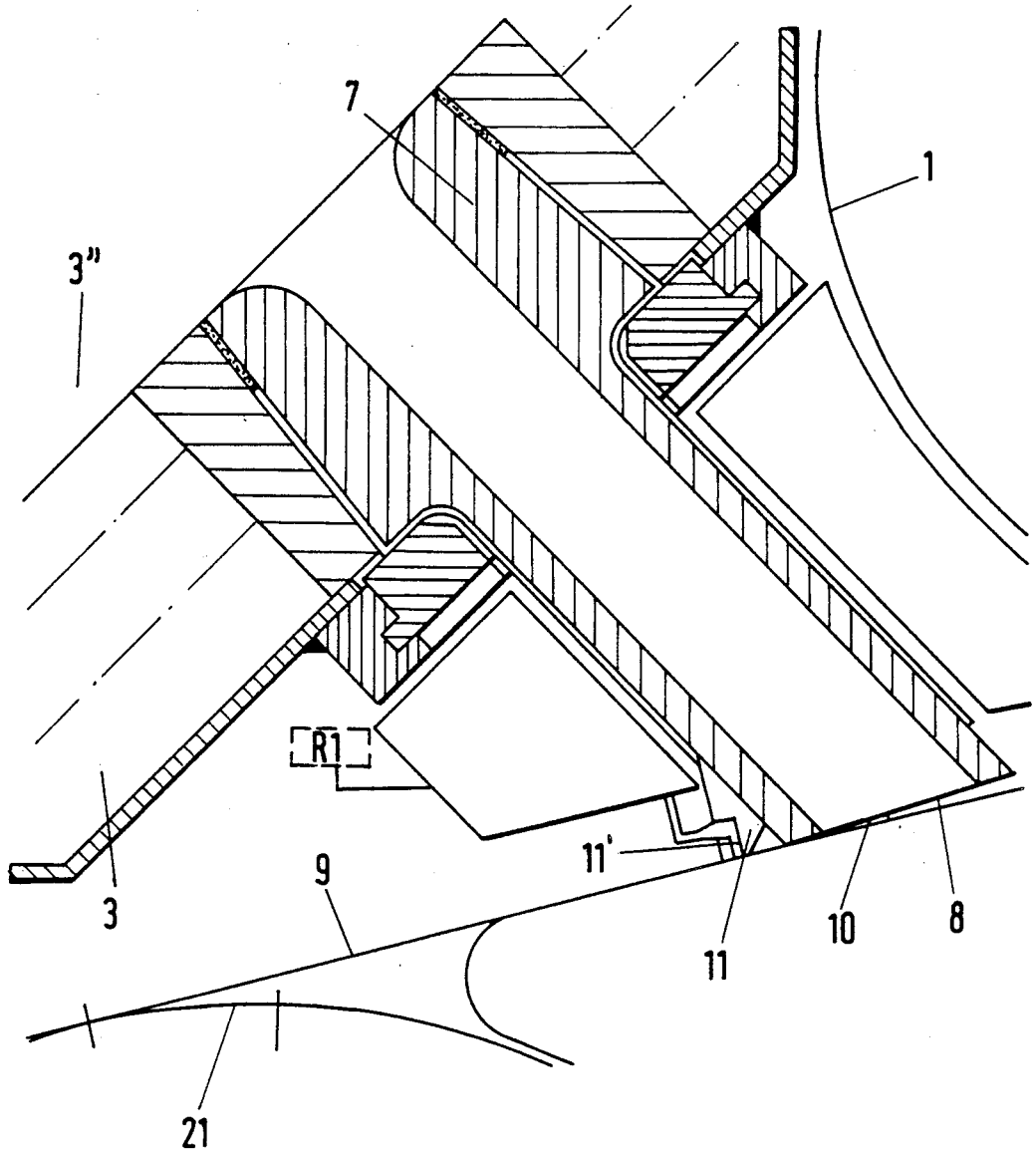
FIG. 3 illustrates the arrangement of a ram pressure measuring device in relation to the casting nozzle of the kind used in FIGS. 1 and 2.

FIG. 2 shows other details and here are shown in particular a carriage 6 is provided for carrying and supporting and thus movably mounting the distributor vessel 3. This carriage 6 is shown in parts in FIG. 1 but FIG. 2 shows the extent to which the carriage runs on the frame 2. The distributor 3 on the carriage 6 can be adjusted as to its elevation by means of a hydraulically operated piston cylinder drive 13. The hydraulically operated piston cylinder drive 13 is included in a control circuit which includes in addition the controller R1 and the pressure measuring device which is connected right next to the nozzle 7 and measures the pressure of the emerging gas 3. This mode of measurement is illustrated in greater detail in FIG. 3. Here the instrument 11 with an opening 11' is arranged on the wall of the casting nozzle 7 facing the transport belt 9 and particularly the device 11 is arranged in the plane of the nozzle exit opening 8 which plane forms an angle of inclination in relation to the plane horizontal casting and cooling belt 9.

Device 11 measures the ram pressure of gas emerging at 11' which ram pressure measures the distance of the nozzle 7 from the belt 9. This pressure value as thus measured is fed to the controller R1 which controls piston cylinder drive 13 in such a manner that the distance between the nozzle 7 from surface of the belt 9 remains constant.

FIG. 2 shows also a thickness measuring instrument 14 being arranged immediately downstream from the casting nozzle 7 as seen in the direction of movement of the belt 9. This device 14 ascertains and measures the thickness of the metal strip 19 just made by the material deposited from the nozzle 7 onto the belt 9. The thickness measuring device 14 operates radiometrically and in accordance with the transmission mode. This device 14 includes a transmitter and a receiver respectively arranged above and below the belt 19.

Measuring device 14 is connected to the controller R2 which in turn controls the pressure of the source of gas 24. On measuring the gas pressure in the discharge chambers 3'' one can use this value as an input for controlling the bath level distance of the molten material 25 within the vessel 3 and that in turn controls the rate of flow of the molten material through the nozzle 7. Depending on the geometry of the distributor 3 and the configuration of the distributor as a twin chamber; depending further on the position of the casting nozzle 7 and on the disposition of the lower edge of the partition 23, the gas source as connected through a low pressure chamber is operated in a controlled mode accordingly. This makes possible to relate the level distance of the molten material in chamber 3' to the amount of molten material that flows into the charge chamber 3' in a controlled fashion such that the flow of molten material to the nozzle 7 is now determined only on the basis of the ferrostatic pressure as it exists in the charge chambers 3'. In other words the control for the outflow of the nozzle is somewhat removed from the nozzle itself and indirectly controlled in that the flow is determined through control of the ferrostatic pressure in the distributor 3.

The output of the strip (19) thickness measuring device 14 is connected to another controller R4 which operates the adjusting structure for varying the distance and spacing of support elements 18. These elements 18 are situated underneath the construction and are established by one roller or several rollers. They are arranged in the area of (i.e. underneath) the exit opening of nozzle opening 7. Through controlling the disposition of these support elements 18 one has available another factor and aspect for controlling the thickness of the strip 19 being made.

Figure 4:
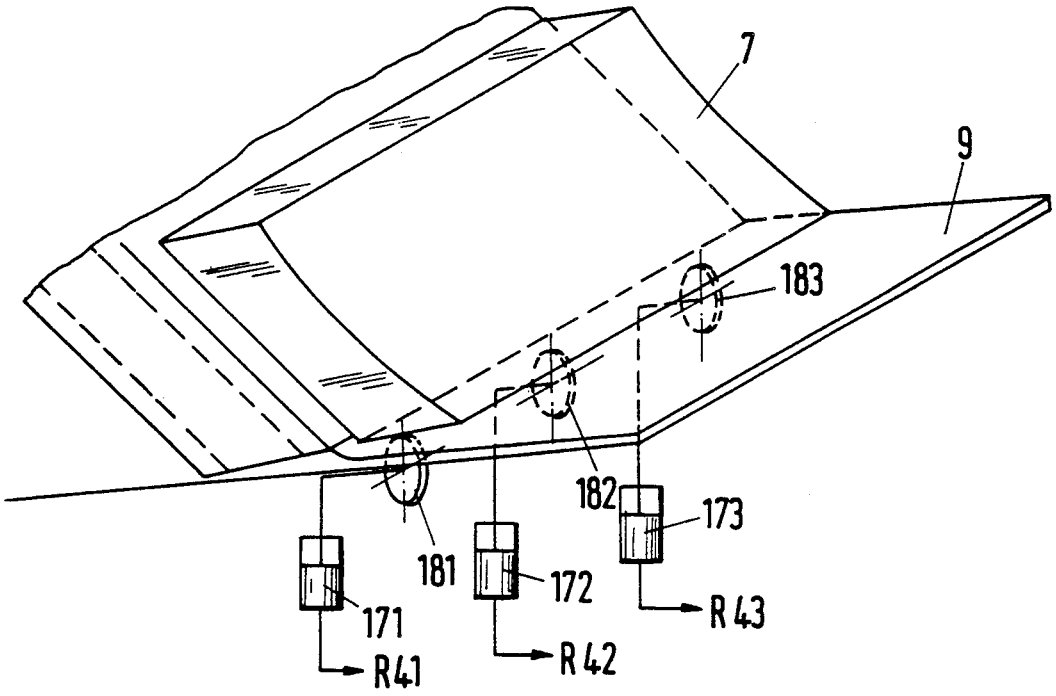
FIG. 4 illustrates the arrangement of plural support elements for the casting and transport belt underneath the casting nozzle of the equipment shown in FIGS. 1 and 2.

The elements 18 are preferably provided through plural individual rollers and one needs of course a corresponding number of adjusting elements 15. This is shown in greater detail in FIG. 4. FIG. 4 shows specifically the casting nozzle 7 with individual rollers 181,182,183 situated and arranged underneath the belt 9, as far as its upper stringer is concerned. Here, each roller (181 or 182 or 183) is associated with and connected to separate individual adjusting elements 171, 172 and 173 respectively and these are in turn connected to controllers R41, R42, R43. This kind of subdividing of the support function of course requires that one has available the corresponding number of measuring devices 14 so that each of the support rollers 181 etc. is associated with a particular measuring device which means that there are as many devices as there are support rollers. This way one obtains a finely tuned adjustment as far as strip thickness is concerned, and in relation to the transverse dimension i.e. the thickness can be controlled in as fine a manner as being necessary over the entire width of the strip being made.

FIG. 2 illustrates a still further control circuit which ascertains the speed of the casting belt and cooling belt 9. The measuring value indicating the belt speed is fed to the controller R3 which in turn operates a piston cylinder drive 16 by means of which the inclination of the casting belt 9 is controlled in dependence upon the belt speed.

Proceeding now to the description of method aspects for operating the particular device for the continuous making of metal strip the molten material is passed from the distributor 3 onto the belt 9. Distributor 3 includes the casting nozzle 7 as stated and the disposition of that nozzle 7 determines the thickness of the strip 19 to be made. The arrangement as described provides for measuring the thickness of the casting and feeding the measured value to the controller R2 wherein a comparison is obtained between the measured value and the characteristic desired value and that in turn measures the pressure in the chamber 3'' under further consideration, broadly as described, of the flow of molten material into the chamber 3'. The method moreover includes measuring the spacing of the casting nozzle 7 through ram pressure measurement in the plane of the exit opening of the nozzle under utilization of a gas stream for measuring ram pressure. That pressure as measured by instrument 11 is fed to the controller R1 wherein again a comparison obtains with the desired value which characterizes the spacing of the nozzle from the belt 9. The controller R1 operates the hydraulic drive 13 for maintaining constant measured value that is the spacing between the casting nozzle 7 and the surface of the belt 9.

As was described with reference to FIG. 4 plural thickness measuring instruments are provided all in the vicinity of the casting nozzle to measure the thickness of the cast product in as fine a resolution transverse to the direction of production as is desired and necessary. Each of these measured values is separately compared with reference values which ideally is identical but does not have to be the same throughout depending on the particular contour that is subject to the desired control (controllers R41, R42 or R43). In each of these, a measuring value is compared with a value and control the particular support member 181 etc. that is respectively associated with the particular measuring device.

The invention is not limited to the embodiments described above but all changes and modifications thereof, not constituting departures from the spirit and scope of the invention, are intended to be included.

I claim:

1. In a casting device for the continuous production of metal strip using an endless cooling and transport belt;

a distributor with a casting nozzle arranged above an upper stringer of the casting belt there being a downstream arranged smoothing roller, said casting belt as well as said distributor being arranged in an inclination adjustable frame, the improvement comprising:

the distributor being constructed as twin chamber with an entrance and charge chamber and an exit and discharge chamber communicating with the entrance chamber, said nozzle being provided at the exit and discharge chamber, the distributor, at least as to its discharge chamber, being gas tightly closed;

a gas pressure controllable source connected to the discharge chamber;

a distance measuring device arranged at the casting nozzle for measuring the distance of the casting nozzle from the casting belt; and a first controller responding to the measuring output of the distance measuring device and provided for controlling elevational and vertical disposition of the distributor within said frame.

2. The improvement as in claim 1, said distance measuring device being a ram pressure device associated with the nozzle and being arranged in an exit plane of that nozzle and at a wall of the nozzle facing the oncoming casting belt, said exit of the nozzle being inclined at an angle in relation to the surface of the casting belt such that the angle opens in the direction of movement of the casting belt.

3. The improvement as in claim 1, said pressure controlled source having its pressure controlled by means of a second controller; the improvement further including means for measuring the thickness of the strip being cast and connected to said second controller and controlling the gas pressure of said source.

4. The improvement as in claim 3, said thickness measuring means including at least one radiometrically operating instrument.

5. The improvement as in claim 3, said thickness measuring means being connected to a third controller which in turn is connected to an adjustment drive for controlling support elements underneath said upper stringer of said casting belt and in a location opposite said casting nozzle.

6. The improvement as in claim 3, there being a plurality of said thickness measuring devices, a corresponding plurality of controllers, a corresponding plurality of adjusting devices and a corresponding plurality of support elements all respectively connected to provide a plurality of control loops for adjusting the support of the casting belt underneath said casting nozzle in different locations across the width of the belt and depending upon the outputs of the various respective measuring instruments.

7. The improvement as in claim 1, said casting nozzle having a width which corresponds to the width of the casting being made.

8. Apparatus as in claim 1, including means for measuring the thickness of the cast product providing:

a controller receiving the measured thickness value to compare the value as measured with a reference value and controlling the gas pressure in the discharge chamber as well as the feed amount of molten material that reaches the feed and entrance chamber.

* * * * *